US008238794B2

(12) United States Patent
Ogata et al.

(10) Patent No.: US 8,238,794 B2
(45) Date of Patent: Aug. 7, 2012

(54) IMAGE FORMING APPARATUS WITH DRIVE DEVICE GENERATING REVERSE PHASE VARIATION

(75) Inventors: Satoshi Ogata, Hachioji (JP); Jun Onishi, Hino (JP); Shinpei Kawasaki, Hiratsuka (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 541 days.

(21) Appl. No.: 12/487,141

(22) Filed: Jun. 18, 2009

(65) Prior Publication Data

US 2009/0317110 A1 Dec. 24, 2009

(30) Foreign Application Priority Data

Jun. 20, 2008 (JP) ..... 2008-161773

(51) Int. Cl.
*G03G 15/00* (2006.01)
*G03G 15/14* (2006.01)
*G03G 21/00* (2006.01)

(52) U.S. Cl. ..... 399/167; 399/36; 399/163; 399/308

(58) Field of Classification Search ..... 399/36, 399/162, 163, 167, 297, 302, 308, 319
See application file for complete search history.

(56) References Cited

U.S. PATENT DOCUMENTS 5,995,802 A * 11/1999 Mori et al. ..... 399/394
6,009,298 A * 12/1999 Sakamaki et al. ..... 399/318
7,257,339 B2 * 8/2007 Yokoyama et al. ..... 399/66

FOREIGN PATENT DOCUMENTS

JP 10-268595 A 10/1998
JP 2004251961 A * 9/2004
JP 2005091944 A * 4/2005
JP 2005176467 A * 6/2005
JP 2006259483 A * 9/2006
JP 2007065069 A * 3/2007
JP 2007-322786 A 12/2007
JP 2008096811 A * 4/2008

* cited by examiner

*Primary Examiner* — David Gray
*Assistant Examiner* — Fred L Braun
(74) *Attorney, Agent, or Firm* — Buchanan Ingersoll & Rooney PC

(57) ABSTRACT

An image forming apparatus includes an image carrier for carrying a toner image, a drive device for driving the image carrier at a predetermined speed, a control device for giving instruction to the drive device to perform predetermined operation, and a transfer device for nipping a recording sheet with a rotary member at the position opposed to the image carrier and for transferring the toner image on the image carrier onto the recording sheet, wherein the control device gives instruction to the drive device to generate a variation having a phase which is reverse to a phase of a variation given to the predetermined speed of the image carrier by a vibration produced at the time of passage of the recording sheet between the image carrier and the transfer device.

18 Claims, 5 Drawing Sheets

IMAGE FORMING APPARATUS WITH DRIVE DEVICE GENERATING REVERSE PHASE VARIATION

This application is based on Japanese Patent Application No. 2008-161773 filed on Jun. 20, 2008 in Japanese Patent Office, the entire content of which is hereby incorporated by reference.

BACKGROUND OF THE INVENTION

The present invention relates to image forming apparatuses such as photocopiers and printers, particularly to measures to be taken against the sudden speed variation which occurs in the conveyance speed of a recording sheet or the drive speed of an image carrier resulting from the impulsive vibration produced at the time of entry of recording sheet into the roller for nipping and conveying the recording sheet, or separation of the recording sheet from the roller.

Some image forming apparatus is provided with the transfer device which transfers a toner image of an image carrier onto a recording sheet while nipping the recording sheet using a rotary member at a position opposed to the image carrier. It is known in these image forming apparatuses that the impulsive vibration produced at the time of passage (entry or separation) of the recording sheet between the image carrier and transfer device provides instantaneous speed variation to the drive speed of the image carrier, and the image in the process of being formed is adversely effected by this speed variation of the image carrier.

In this case, when thick paper is used, speed variation tends to occur due to the vibration at the time of entry or separation. This vibration may result in local but conspicuous deterioration of an image, as exemplified by transfer misalignment on the transfer section or uneven exposure on the image in the process of exposure.

The Japanese Unexamined Patent Application Publication No. 10-268595 and Japanese Unexamined Patent Application Publication No. 2007-322786 propose the measures against the instantaneous speed variation of the image carrier affected by the vibration generated at the time of recording sheet being nipped and conveyed, as described above.

The above two Japanese Unexamined Patent Application Publication documents try to adjusting the tension of the transfer belt, to give slack to the belt, to absorb vibration, and to reduce the aforementioned influence of the impulsive vibration. However, if slack is given to the belt, a slip will be produced. This is not to be preferred.

Generally, it is theoretically possible to enhance the mechanical rigidity of an apparatus to ensure that the aforementioned vibration will not occur. In actual practice, however, it is difficult to further enhance the current mechanical rigidity because of the problems with the size of the apparatus, the position and cost of a flywheel, and the overall apparatus costs.

Generally again, to avoid the aforementioned vibration, impact-absorbable flexible rollers can be used as a transfer roller and conveyance rollers of various portions to absorb impact at the time of entry or separation. In the transfer section, however, this is not preferred in the point of improving transfer efficiency and image quality.

SUMMARY

In view of the problems described above, an object of the present invention is to provide an image forming apparatus capable of ensuring that the conveyance speed of the recording sheet or the drive speed of image carrier will not be subjected to sudden speed variation resulting from the impulsive vibration produced at the time of entry or separation in the roller when recording sheet is nipped and conveyed, whereby the image quality is protected against being deteriorated.

An image forming apparatus of an embodiment of the present invention as a device for solving the aforementioned problems includes an image carrier for carrying a toner image, a drive device for driving the image carrier at a predetermined speed, a control device for giving instructions to the drive device to perform predetermined operations, a transfer device for nipping a recording sheet with a rotary member at the position opposed to the image carrier and for transferring the toner image on the image carrier onto the recording sheet, wherein the control device gives instructions to the drive device to generate the variation having the phase reverse to that of the variation given to a predetermined speed of the image carrier by the vibration produced at the time of passage of the recording sheet between the image carrier and transfer device.

DETAILED DESCRIPTION OF THE PREFERRED EMBODIMENTS

Referring to diagrams, the following describes the details of the best mode (preferred embodiment) for carrying out the present invention.

[First Embodiment]

Figure 1:
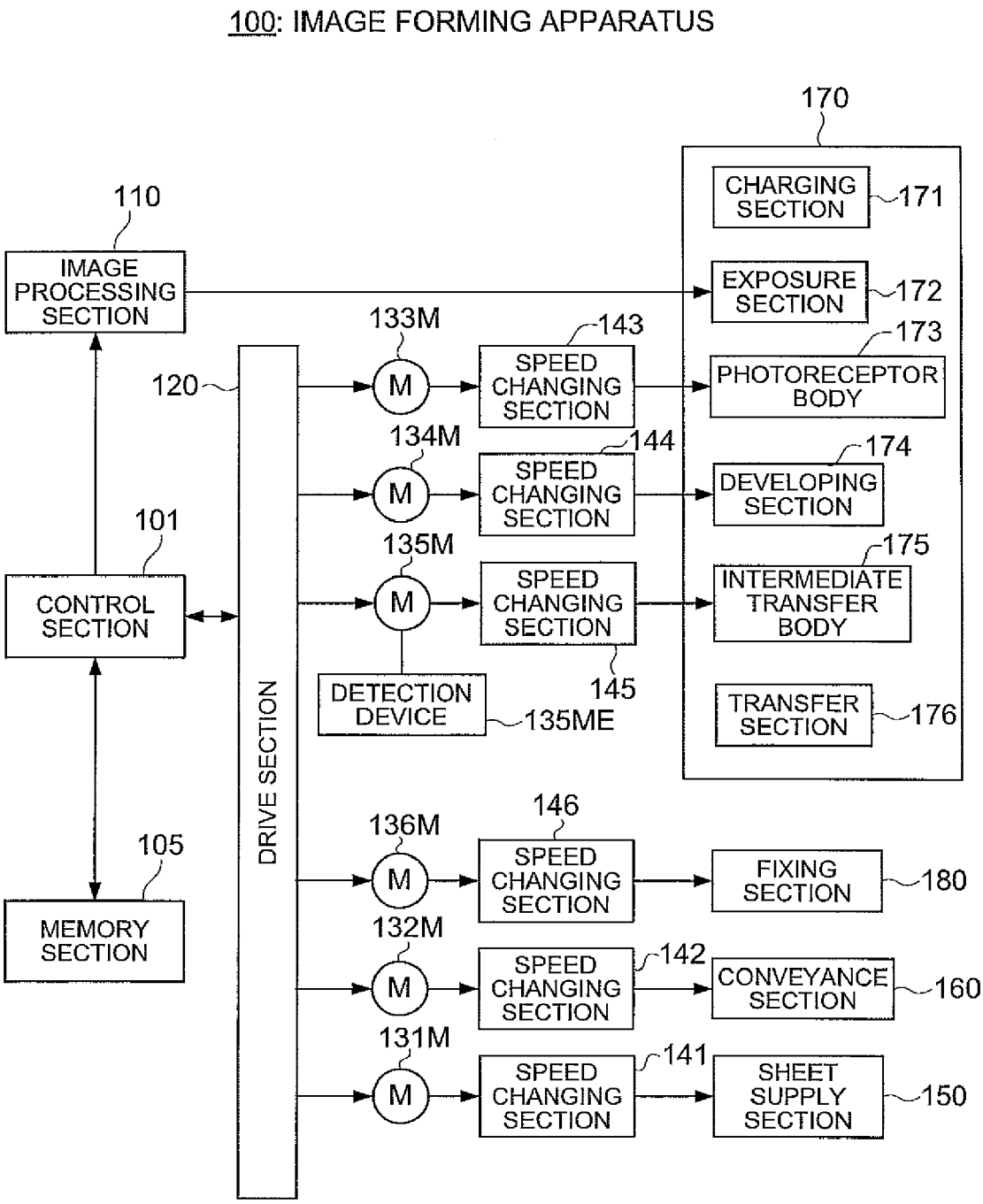
FIG. 1 is a schematic view representing the structure of an image forming apparatus in an embodiment of the present invention.
Figure 2:
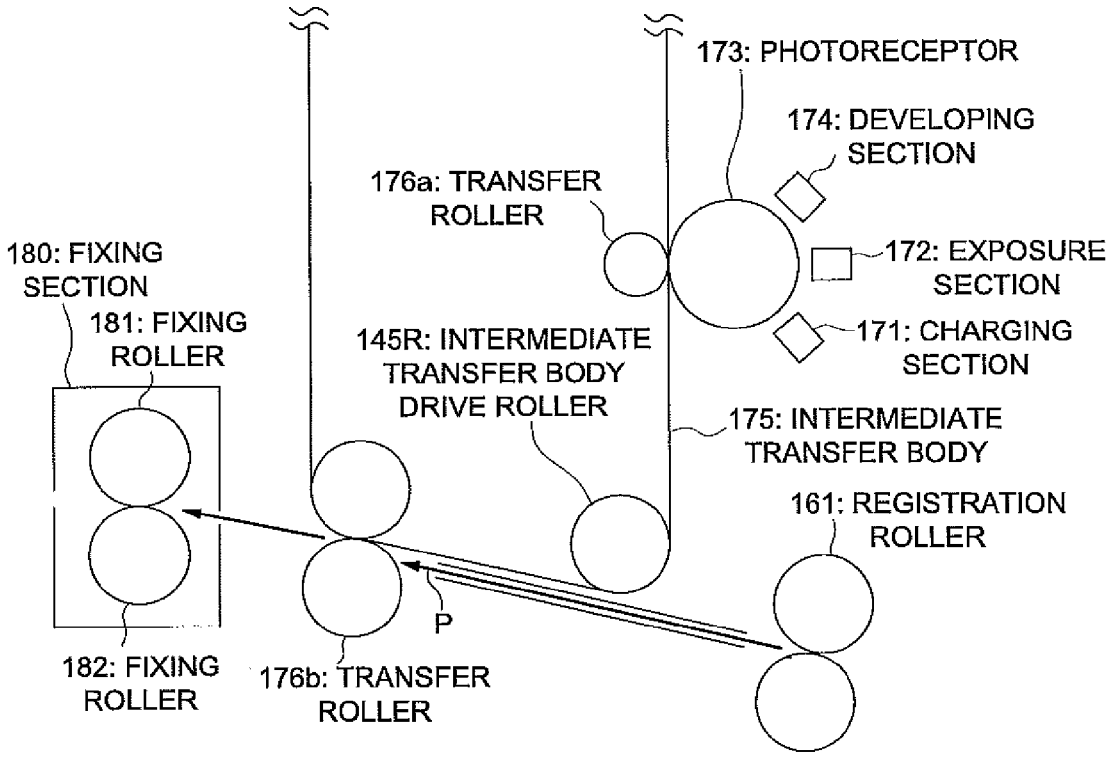
FIG. 2 is a schematic view representing the structure of an image forming apparatus in an embodiment of the present invention.

The following describes the structure of the image forming apparatus 100 in the first embodiment with reference to FIGS. 1 and 2.

In FIGS. 1 and 2, illustration of the general known components not directly related to the characteristic operation or control of the present embodiment is omitted.

In the image forming apparatus 100, the control section 101 includes a CPU for the control of various components of the image forming apparatus 100, and has a function of providing the drive device with an instruction to generate a reverse phase variation against the variation with respect to the predetermined speed of the image carrier resulting from the vibration produced by the passage of a recording sheet between the image carrier and transfer device.

The memory section 105 is a storage device for storing various types of data. In this embodiment, the memory section 105 stores the data on drive signal waveform required to generate the reverse phase variation against the detected speed variation.

The image processing section 110 applies image processing to the image data for forming an image so that the image data is made suitable for image formation.

The drive section 120 is a drive device for driving the motor that makes various components operate at a predetermined speed so that this motor will rotate a predetermined speed.

The motor 131M is a drive source for operating the sheet supply roller of the sheet supply section 150. The motor 132M is a drive source for operating the conveyance roller of various components of the conveyance section 160. The motor 133M is a drive source for operating such a photoreceptor body 173 as a photoreceptor drum. The motor 134M is a drive source for operating the development roller of the developing section 174. The motor 135M is a drive source for operating an intermediate transfer body 175. These motors 131M through 136M are collectively called a motor 130M.

The speed changing section 141 is a speed change mechanism for operating the sheet supply roller of the sheet supply section 150 by the torque of the motor. The speed changing section 142 is a speed change mechanism for the conveyance roller of each component of the conveyance section 160 being operated by the torque of the motor. The speed changing section 143 is a speed change mechanism for such a photoreceptor body 173 as a photoreceptor drum being driven by the motor torque. The speed changing section 144 is a speed change mechanism for such a developing section 174 as a development roller being operated by motor torque. The speed changing section 145 is a speed change mechanism for the intermediate transfer body 175 being operated by motor torque. These speed changing sections 141 through 146 will be collectively called a speed changing section 140.

The sheet supply section 150 is a sheet supply device for ensuring that the recording sheets mounted in a plurality of sheet supply trays are conveyed to the position of image formation by a sheet supply roller.

The conveyance section 160 is a conveyance device for ensuring that recording sheets conveyed from the sheet supply section 150 are conveyed at a predetermined conveyance speed, and is provided with a registration roller 161 and various types of other conveyance rollers. It should be noted that the registration roller 161 is a conveyance device for nipping and conveying the recording sheet on the upstream side of the transfer device.

The process unit 170 is a device that performs various operations for the purpose of forming an image on recording sheet, and includes a charging section 171 for charging a photoreceptor body as predetermined, an exposure section 172 for exposing the photoreceptor body in response to image data, a photoreceptor body 173 on which an electrostatic latent image is formed by exposure, a developing section 174 for developing an electrostatic latent image of the photoreceptor body 173 and converting this image into a toner image, an intermediate transfer body 175 as an image carrier for carrying a toner image after the toner image on the photoreceptor body 173 is transferred to this intermediate transfer body 175 and a transfer section 176 provided with a transfer roller 176*a* and transfer roller 176*b*.

Figure 3:
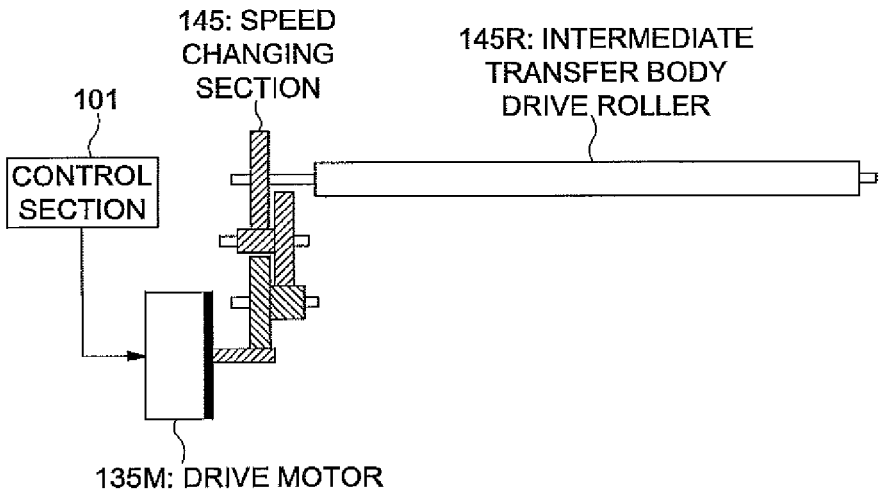
FIG. 3 is a schematic view representing the structure of an image forming apparatus in an embodiment of the present invention.

The intermediate transfer body 175 is driven at a predetermined speed by the intermediate transfer body drive roller 145R (FIGS. 2 and 3) through the motor 135M and speed changing section 145.

The transfer roller 176*a* transfers the toner image of the photoreceptor body 173 onto the intermediate transfer body 175, and the transfer roller 176*b* transfers the toner image of the intermediate transfer body 175 onto recording sheet.

The transfer roller 176*b* constitutes a transfer device that nips recording sheet by means of a rotary member at the position opposed to the intermediate transfer body 175 as an image carrier and transfers the toner image on this image carrier onto the recording sheet.

While nipping and conveying the recording sheet on the downstream side of the transfer roller 176*b*, the fixing section 180 performs the fixing operations so that the toner image is fixed and stabilized on the recording sheet.

Figure 4:
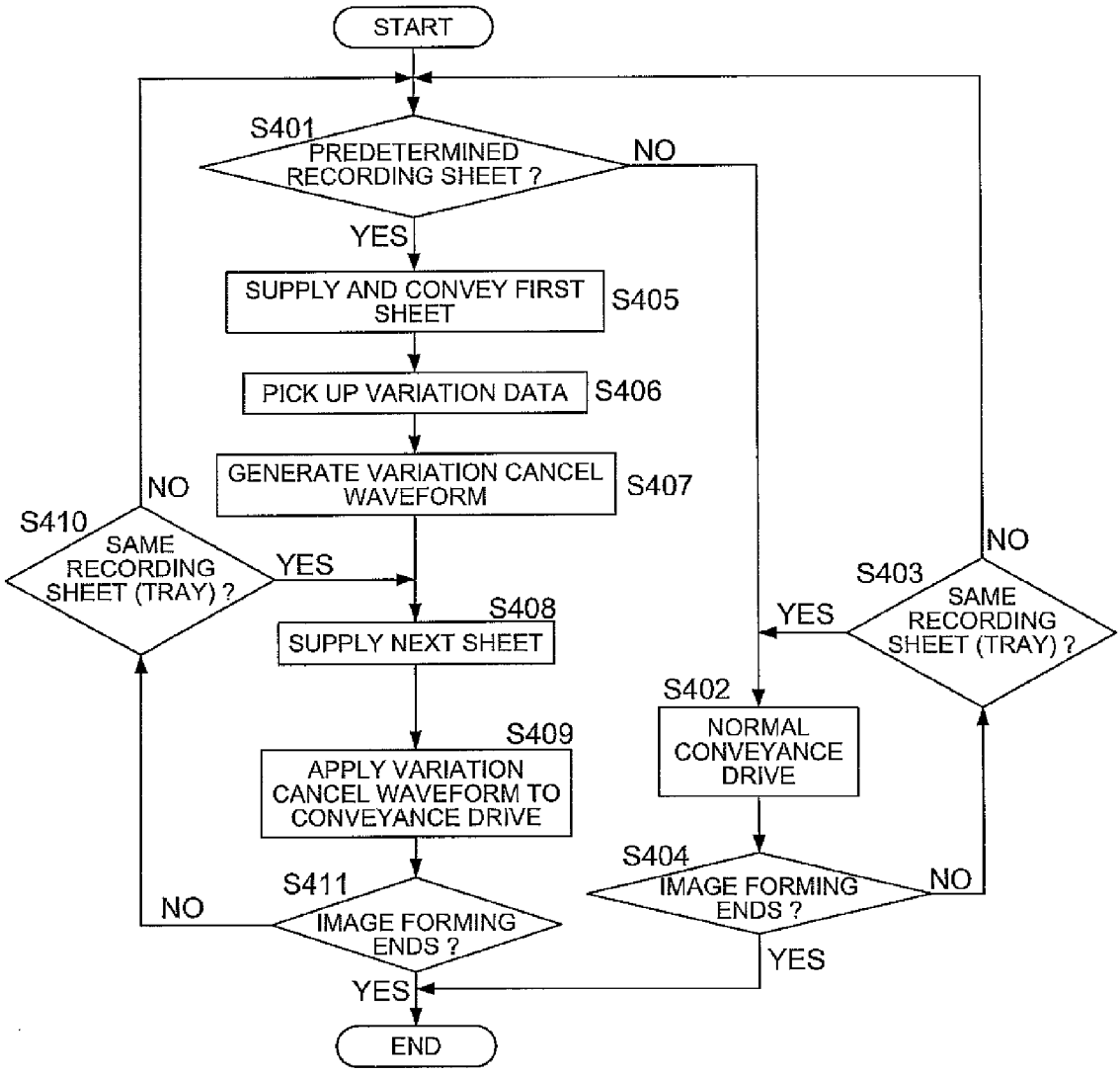
FIG. 4 is a flow chart showing the state of operation of the image forming apparatus in an embodiment of the present invention.

Referring to the flow chart of FIG. 4 and time chart of FIGS. 5*a*-5*f*, the following describes the operation of the image forming system provided with an image forming apparatus 100 according to the present embodiment. FIG. 4 is a flow chart that will be used to describe the conveyance of recording sheet mainly.

When image formation has started, the control section 101 refers to the information about the sheet supply tray of the recording sheet selected for the job of image formation having been started, and check whether or not the selected recording sheet has a weight predetermined or more (Step S401 of FIG. 4). In this case, the predetermined weight is preferably determined in advance. For the thick paper heavier than the paper used as a normal photo copy paper, reference is made to the information on basis weight and others. This information is preferably inputted to be stored in the memory section 105 to be referred to when the recording sheet is set on the image forming apparatus.

The drive for conveyance of the recording sheet which does not have a weight predetermined or more (No in Step S401 of FIG. 4) is repeated for every next recording sheet normally (Step S402 of FIG. 4) until termination of a series of image forming operation (No in Step S404 of FIG. 4), if the recording sheet is from the same sheet supply tray (Yes in Step S403 of FIG. 4). Even during a series of image forming operation (No in Step S404 of FIG. 4), when a different recording sheet is to be inserted as a separator (No in Step S403 of FIG. 4), the operation goes back to the decision of the recording sheet (Step S401 of FIG. 4) to repeat the aforementioned procedures from the beginning.

When the recording sheet has a weight predetermined or more (Yes in Step S401 of FIG. 4), the first sheet is supplied and conveyed (Step S405 of FIG. 4), in the first place.

In this case, the control section 101 acquires the data on speed variation from the encoder as a detection device 135ME built in the motor 135M through the drive section 120 (Step S406 of FIG. 4). This data is about speed variation which is generated by the impulsive vibrations resulting from each of the steps of entry of sheet, upstream separation while being nipped, downstream entry while being nipped, and separation.

Figure 5A:
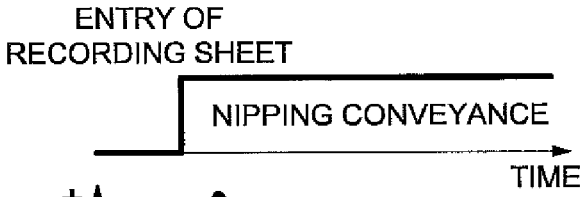
FIGS. 5*a*-5*f* are time charts showing the operation of the image forming apparatus in an embodiment of the present invention.
Figure 5B:
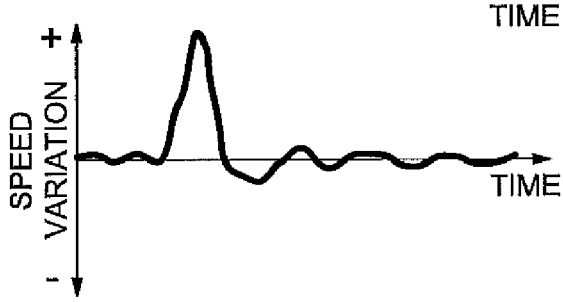

When the recording sheet enters the space between the intermediate transfer body 175 and transfer roller 176*b* (L→H) in FIG. 5*a*), there is a speed variation exhibiting an instantaneous speed rise, as shown in FIG. 5*b*. This is considered to have occurred because the recording sheet being driven and conveyed by the registration roller 161 on the upstream side have entered the space between the intermediate transfer body 175 and transfer roller 176*b*.

Figure 6A:
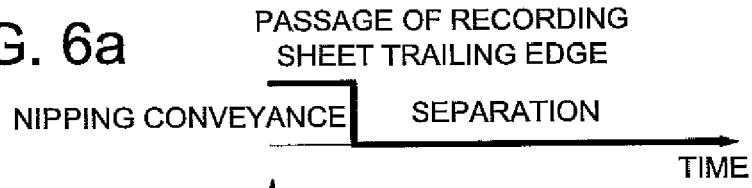
FIGS. 6*a*-6*f* are time charts showing the operation of the image forming apparatus in an embodiment of the present invention.
Figure 6B:
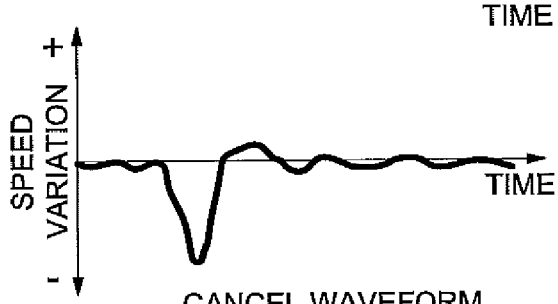

Further, at the time of passage (separation) of the trailing edges of the recording sheet being nipped and conveyed between the intermediate transfer body 175 and transfer roller 176*b* (H→L in FIG. 6*a*), there is a speed variation exhibiting an instantaneous speed reduction, as shown in FIG. 6*b*. This is considered to have been caused because the recording sheet being driven and conveyed by the fixing rollers 181 and 182 on the downstream side has ceased to be present between the intermediate transfer body 175 and transfer roller 176*b*, and the intermediate transfer body 175 has come in contact with the transfer roller 176*b*.

After this speed variation data has been acquired, when the recording sheet in the process of image formation is conveyed, the variation cancel waveform is produced in such a way that the drive signal of the motor 135M includes the variation component of reverse phase (reverse phase variation component) capable of offsetting the aforementioned variation (Step S407 of FIG. 4).

Correspondence relationship between the speed variation component and variation cancel waveform is stored in the memory section 105 in advance, and the control section 101 generates the variation cancel waveform in conformance to the detected speed variation component by reading it from the memory section 105 (Step S407 of FIG. 4). Due to the influence of the motor 135M and speed changing section 145, there will be a slight delay in the actual appearance of the reverse phase variation component in the intermediate transfer body drive roller 145R. The variation cancel waveform should be added earlier corresponding to the delay time. The delay time is preferably stored in the memory section 105.

The control section 101 supplies the drive signal (FIGS. 5*c* and 6*c*) to the motor 135M, and supplies and conveys the second recording sheet (Step S408 of FIG. 4). Further, the control section 101 adds a variation cancel waveform to this drive signal at a predetermined time (Step S409 of FIG. 4). Due to the influence of the motor 135M and speed changing section 145, there will be a slight delay in the actual appearance of the reverse phase variation component in the intermediate transfer body drive roller 145R.

Figure 5C:
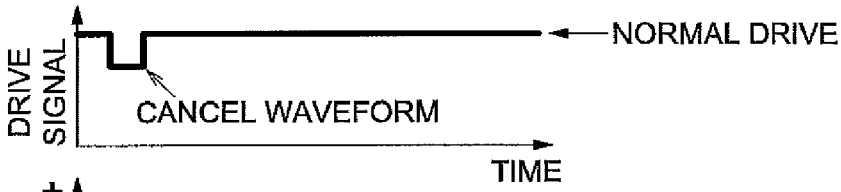
Figure 5D:
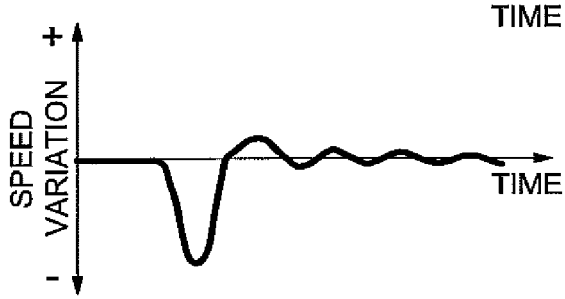
Figure 5E:
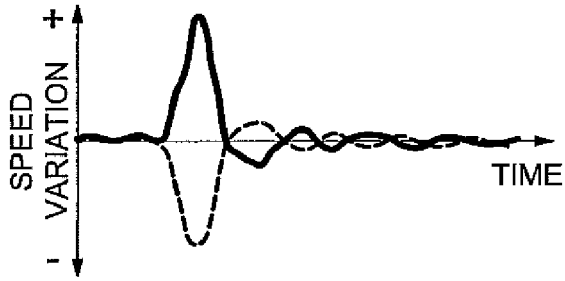
Figure 5F:
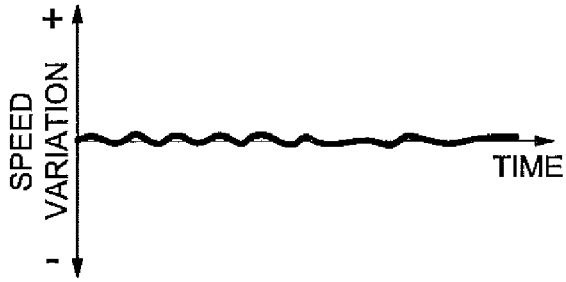

As the variation cancel waveform, the waveform that reduces the drive signal of FIG. 5*c* only for a predetermined period of time is added to the speed variation component exhibiting an instantaneous rise shown in FIG. 5*b*. The speed variation component exhibiting an instantaneous reduction shown in FIG. 5*d* is generated under the influence of this variation cancel waveform. This corresponds to the reverse phase variation component of the variation component produced under the influence of the recording sheet.

Figure 6C:
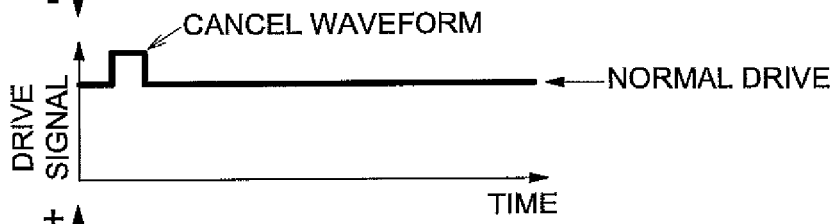
Figure 6D:
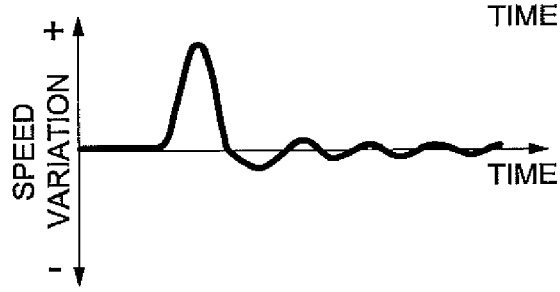
Figure 6E:
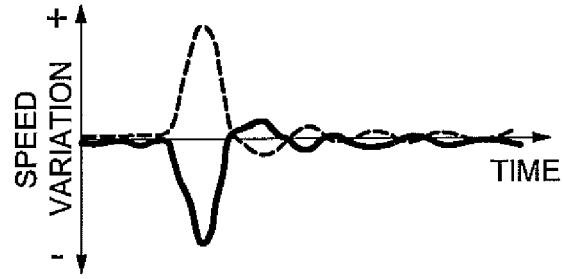
Figure 6F:
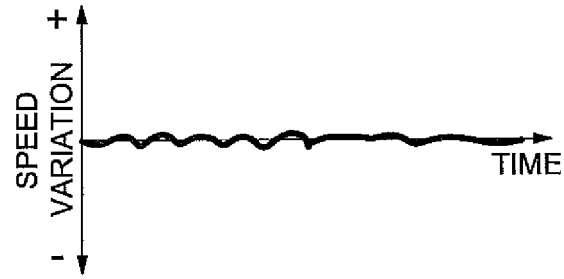

As the variation cancel waveform, the waveform that increases the drive signal of FIG. 6*c* only for a predetermined period of time is added to the speed variation component of instantaneous reduction shown in FIG. 6*b*. The speed variation component exhibiting an instantaneous rise shown in FIG. 6*d* is generated under the influence of this variation cancel waveform. This corresponds to the reverse phase variation component of the variation component generated under the influence of the recording sheet.

The speeds of the intermediate transfer body drive roller 145R and intermediate transfer body 175 are converted by the addition of the variation cancel waveform in such a way that the variation component and reverse phase variation component are offset with each other (FIGS. 5*e* and 5*f* and FIGS. 6*e* and 6*f*).

In this example, a rectangular variation cancel waveform is added. However, another waveform can be added.

The drive for conveyance of the sheet is repeated for every next sheet in response to the drive signal with the aforementioned reverse phase variation component added thereon (Step S409 of FIG. 4) until termination of a series of image forming operation (No in Step S411 of FIG. 4), if the recording sheet is from the same sheet supply tray (Yes in Step S410 of FIG. 4). Even during a series of image forming operation (No in Step S411 of FIG. 4), when a different recording sheet is to be inserted as a separator (No in Step S410 of FIG. 4), the operation goes back to the decision of the recording sheet (Step S401 of FIG. 4) to repeat the aforementioned procedures from the beginning.

[Another Embodiment (1)]

In the aforementioned embodiment, for the recording sheets having a predetermined weight, the first sheet is conveyed, and variation component is acquired. In response to the result of this acquisition, the cancel waveform of reverse phase variation component is generated. In addition, it is possible to take steps of acquiring the variation component contained after offsetting the variation by the cancel waveform used in the second or later sheet, and making more minute corrections to the cancel waveform.

[Another Embodiment (2)]

In the aforementioned embodiment, for the recording sheets having a predetermined weight, the first sheet is conveyed, and variation component is acquired. In response to the result of this acquisition, the cancel waveform of reverse phase variation component is generated. By contrast, it is possible to store the cancel waveform in the memory section 105 in advance in response to the weight and type of paper, and to read out the cancel waveform according to the weight and type of the paper.

[Another Embodiment (3)]

The above description refers to the speed variation resulting from the impulsive vibration caused by the entry of recording sheet into the contact portion between the intermediate transfer body 175 and transfer roller 176*b*, or separation of the recording sheet from the contact portion. However, the present invention is not restricted thereto.

For example, even when the recording sheet is nipped and conveyed by the contact portion between the intermediate transfer body 175 and transfer roller 176*b*, impulsive vibration also occurs when the leading edge of the recording sheet enters the conveyance device (fixing rollers 181 and 182 of the fixing section 180) for nipping and conveying the recording sheet on the downstream side of the abovementioned nipping and conveying portion. This vibration is transferred to the recording sheet and then to the intermediate transfer body 175. Variation having the phase reverse to that of the abovementioned variation given to the predetermined speed of the intermediate transfer body 175 can be generated. This arrangement cancels the adverse effect of the vibration produced when the recording sheet enters the conveyance device on the downstream side, while the recording sheet is nipped between the image carrier and the transfer device. In this case, the fixing rollers 181 and 182 of the fixing section 180 are assumed to be the conveyance devices on the downstream side. However, a conveyance device other than the fixing section 180 can be present instead.

[Another Embodiment (4)]

The above description refers to the speed variation resulting from the impulsive vibration caused by the entry of recording sheet into the contact portion between the intermediate transfer body 175 and transfer roller 176*b*, or separation of the recording sheet from the contact portion. However, the present invention is not restricted thereto.

For example, even when the recording sheet is nipped and conveyed by the contact portion between the intermediate transfer body 175 and transfer roller 176*b*, impulsive vibration also occurs when the trailing edge of the recording sheet passes through (separates from) the conveyance device (e.g., registration roller 161) for nipping and conveying the recording sheet on the upstream side of the abovementioned nipping and conveying portion. This vibration is transferred to the recording sheet and then to the intermediate transfer body 175. Variation having the phase reverse to that of the abovementioned variation given to the predetermined speed of the intermediate transfer body 175 can be generated. This arrangement cancels the adverse effect of the vibration produced when the trailing edge of the recording sheet passes through the conveyance device on the upstream side, while the recording sheet is nipped between the image carrier and transfer device. In this case, the registration roller 161 is assumed as the conveyance device on the upstream side. However, a conveyance device other than the registration roller can be present instead.

[Another Embodiment (5)]

The above description refers to the speed variation resulting from the impulsive vibration caused by the entry of recording sheet into the contact portion between the intermediate transfer body 175 and transfer roller 176*b*, or separation of the recording sheet from the contact portion. However, the present invention is not restricted thereto. For example, a preferable result can be achieved by generating the reverse phase variation component and applying the same in the similar manner, even when a speed variation component is produced by the shock that occurs at the time of entry or at the time of separation of the recording sheet between the photoreceptor drum instead of the intermediate transfer body 175 and the transfer roller.

[Another Embodiment (6)]

In the above description, measures are preferably taken to handle not only the speed variation resulting from the impulsive vibration caused by the entry of recording sheet into the contact portion between the intermediate transfer body 175 and transfer roller 176*b* (the first embodiment), and the speed variation resulting from the impulsive vibration caused by the separation of recording sheet from the contact portion between the intermediate transfer body 175 and transfer roller 176*b* (the first embodiment), but also the impulsive vibration resulting from entry of the leading edge of the recording sheet into the conveyance device (fixing rollers 181 and 182 of the fixing section 180 or the like) for nipping and conveying the recording sheet on the downstream side of the abovementioned nipping and conveying portion while this recording sheet is nipped and conveyed by the contact portion between the intermediate transfer body 175 and transfer roller 176*b* (the another embodiment (3)), and the impulsive vibration resulting from the passage (separation) of the trailing edge of the recording sheet through the conveyance device (e.g., registration roller 161 or the like) for nipping and conveying the recording sheet on the upstream side of the abovementioned nipping and conveying portion, while this recording sheet is nipped and conveyed by the contact portion between the intermediate transfer body 175 and transfer roller 176*b* (the another embodiment (4)).

This arrangement makes it possible to properly handle any of impulsive vibrations having occurred at individually different time or at the same time (or nearly at the same time) as a combination of any of them. To be more specific, even if a speed variation component is caused by each of the impulsive vibrations, favorable results can be achieved by proper generation and addition of the reverse phase variation components.

In response to the variation resulting from possible impulsive vibrations, it is possible to make such arrangements as to handle the required cases such as the first embodiment (or another embodiment (5))+another embodiment (3), the first embodiment (or another embodiment (5))+another embodiment (4), the first embodiment (or another embodiment (5))+ another embodiment (3)+another embodiment (4), and others.

[Another Embodiment (7)]

The above description refers to the specific example of the monochromatic image forming apparatus. The present invention is not restricted thereto. Satisfactory results can be also obtained in the case of a color image forming apparatus.

[Effects Obtained from Embodiments]

According to the present embodiment discussed so far, the following advantages are obtained for example.

(1) In an embodiment of this image forming apparatus, a drive device generates the variation having the phase reverse to that of the variation given to a predetermined speed of the image carrier by the vibration produced by the passage of the recording sheet between an image carrier and transfer device.

Here a reverse-phase variation is produced to offset the vibration caused by the passage of the recording sheet. This arrangement eliminates the need of slacking the belt and handles the case where the image carrier is a drum, not a belt. Without the need of improving the mechanical rigidity of the overall apparatus or the need of using an elastic roller, this arrangement minimizes the speed variation of the image carrier resulting from sudden vibration without sacrificing the image quality. Thus, this arrangement ensures protection against possible deterioration of image quality.

(2) In an embodiment of the image forming apparatus described in the aforementioned (1), measures are provided to generate a variation having the phase reverse to that of the variation given to a predetermined speed of the image carrier by the vibration produced by the entry of the leading edge of the recording sheet between the image carrier and transfer device. This arrangement eliminates the adverse effect of the vibration produced by the entry of the leading edge of the recording sheet between the image carrier and transfer device.

(3) In an embodiment of the image forming apparatus described in the aforementioned (1) and/or (2), measures are provided to generate the variation having the phase reverse to that of the variation given to a predetermined speed of the image carrier by the vibration produced by the passage of the trailing edge of the recording sheet nipped between an image carrier and transfer device. This arrangement eliminates the adverse effect of the vibration produced by the passage (separation) of the trailing edge of the recording sheet nipped between an image carrier and transfer device. To put it another way, measures are taken to handle the speed variation resulting from any one of the aforementioned impulsive vibrations or a combination of a plurality of the aforementioned impulsive vibrations. This arrangement eliminates the adverse effect of the variation that may be caused by individual vibrations separately or as a combination.

(4) In an embodiment of the image forming apparatus described in any one of the aforementioned (1) through (3) or in any combination thereof, measures are provided to generate the variation having the phase reverse to that of the variation given to a predetermined speed of the image carrier by the vibration resulting from entry of the leading edge of the recording sheet into the conveyance device for nipping and conveying the recording sheet on the downstream side of the transfer device, while the recording sheet is nipped between the image carrier and transfer device. This arrangement removes the adverse effect of the vibration produced by the entry of the recording sheet into the conveyance device on the downstream side while the recording sheet is nipped between the image carrier and transfer device. To put it another way, because measures are provided to handle the speed variation resulting from any one of the aforementioned impulsive vibrations or any combination thereof, it is possible to remove the adverse effect of the variation that may be caused by individual vibrations separately or as a combination.

(5) In an embodiment of the image forming apparatus described in any one of the aforementioned (1) through (4) or in any combination thereof, measures are provided to generate the variation having the phase reverse to that of the variation given to a predetermined speed of the image carrier by the vibration resulting from passage of the trailing edge of the recording sheet through the conveyance device for nipping and conveying the recording sheet on the upstream side, while the recording sheet is nipped between the image carrier and transfer device. This arrangement eliminates the adverse effect of the vibration produced by the passage (separation) of the recording sheet through the conveyance device on the upstream side, while the recording sheet is nipped between the image carrier and transfer device. To put it another way, when measures are provided to handle the speed variation resulting from any one of the aforementioned impulsive vibrations or any combination thereof, it is possible to remove the adverse effect of the variation that may be caused by individual vibrations separately or as a combination.

What is claimed is:

1. An image forming apparatus comprising:

an image carrier for carrying a toner image;

a drive device for driving the image carrier at a predetermined speed;

a transfer device for nipping a recording sheet with a rotary member at a position opposed to the image carrier and for transferring the toner image on the image carrier onto the recording sheet; and a control device for giving instruction to the drive device to generate a variation having a phase which is reverse to a phase of a variation given to the predetermined speed of the image carrier by a vibration produced at a time of passage of the recording sheet between the image carrier and the transfer device, wherein the control device gives the instruction to generate a variation having a phase which is reverse to a phase of the variation given by a vibration produced at a time of passage of a first recording sheet between the image carrier and the transfer device, the control device giving the instruction when a second recording sheet which comes next to the first recording sheet, passes between the image carrier and the transfer device.

2. The image forming apparatus of claim 1, wherein the variation given by the vibration is caused by a vibration produced at a time of entry of a leading edge of the recording sheet between the image carrier and the transfer device.

3. The image forming apparatus of claim 1, wherein the variation given by the vibration is caused by a vibration produced at a time when a trailing edge of the recording sheet nipped between the image carrier and the transfer device passes therebetween.

4. The image forming apparatus of claim 1, further comprising:

a conveyance device for conveying the recording sheet while nipping the recording sheet on a downstream side of the transfer device, wherein the variation given by the vibration is caused by a vibration produced at a time of entry of a leading edge of the recording sheet into the conveyance device while the recording sheet is nipped between the image carrier and the transfer device.

5. The image forming apparatus of claim 1, further comprising:

a conveyance device for conveying the recording sheet while nipping the recording sheet on a upstream side of the transfer device, wherein the variation given by the vibration is caused by a vibration produced at a time of passage of a trailing edge of the recording sheet through the conveyance device while the recording sheet is nipped between the image carrier and the transfer device.

6. The image forming apparatus of claim 1, wherein the control device gives the instruction to generate a variation having a phase which is reverse to a phase of the variation created as a result of the generation of the variation at the time of passage of the second recording sheet between the image carrier and the transfer device, the control device giving the instruction when a third recording sheet which comes next to the second recording sheet, passes between the image carrier and the transfer device.

7. The image forming apparatus of claim 1 further comprising, a memory section for storing various types of data.

8. The image forming apparatus of claim 7, wherein the memory section stores information about a sheet supply tray of the recording sheet and the control device judges whether a weight of the recording sheet is greater than a predetermined weight.

9. The image forming apparatus of claim 7, wherein the memory section stores data relating to a variation cancel waveform required to generate a variation having a phase reverse to a phase of the variation given by the vibration.

10. The image forming apparatus of claim 9 further comprising, a detection device for detecting the variation given by the vibration, wherein the memory section stores data relating to the variation cancel waveform required to generate a variation having a phase reverse to a phase of the detected variation.

11. The image forming apparatus of claim 9, wherein the memory section stores a relationship between the variation given by the vibration and the variation cancel waveform.

12. The image forming apparatus of claim 9, wherein the memory section stores a delay time between a time when the variation cancel waveform is applied and a time when the variation having the reverse phase occurs in the drive device.

13. The image forming apparatus of claim 9, wherein the memory section stores the variation cancel waveform corresponding to a weight of the recording sheet or a type of the recording sheet.

14. The image forming apparatus of claim 1, wherein the image carrier is a belt-type intermediate transfer body.

15. The image forming apparatus of claim 1, wherein the image carrier is a photoreceptor drum.

16. An image forming apparatus comprising:

an image carrier for carrying a toner image;

a drive device for driving the image carrier at a predetermined speed;

a transfer device for nipping a recording sheet with a rotary member at a position opposed to the image carrier and for transferring the toner image on the image carrier onto the recording sheet;

a control device for giving instruction to the drive device to generate a variation having a phase which is reverse to a phase of a variation given to the predetermined speed of the image carrier by a vibration produced at a time of passage of the recording sheet between the image carrier and the transfer device; and a memory section which stores various types of information including information about a sheet supply tray of the recording sheet;

wherein the control device judges whether a weight of the recording sheet is greater than a predetermined weight.

17. An image forming apparatus comprising:

an image carrier for carrying a toner image;

a drive device for driving the image carrier at a predetermined speed;

a transfer device for nipping a recording sheet with a rotary member at a position opposed to the image carrier and for transferring the toner image on the image carrier onto the recording sheet;

a control device for giving instruction to the drive device to generate a variation having a phase which is reverse to a phase of a variation given to the predetermined speed of the image carrier by a vibration produced at a time of passage of the recording sheet between the image carrier and the transfer device; and a memory section which stores various types of information including a delay time between a time when a variation cancel waveform which is required to generate a variation having a phase reverse to a phase of the variation given by the vibration is applied and a time when the variation having the reverse phase occurs in the drive device.

18. An image forming apparatus comprising:

an image carrier for carrying a toner image;

a drive device for driving the image carrier at a predetermined speed;

a transfer device for nipping a recording sheet with a rotary member at a position opposed to the image carrier and for transferring the toner image on the image carrier onto the recording sheet;

a control device for giving instruction to the drive device to generate a variation having a phase which is reverse to a phase of a variation given to the predetermined speed of the image carrier by a vibration produced at a time of passage of the recording sheet between the image carrier and the transfer device; and a memory section which stores various types of information including a variation cancel waveform which is required to generate a variation having a phase reverse to a phase of the variation given by the vibration, and which corresponds to a weight of the recording sheet or a type of the recording sheet.

* * * * *